US007709790B2

(12) United States Patent
Guckenberger et al.

(10) Patent No.: US 7,709,790 B2
(45) Date of Patent: May 4, 2010

(54) REMOVABLE ION SOURCE THAT DOES NOT REQUIRE VENTING OF THE VACUUM CHAMBER

(75) Inventors: George B. Guckenberger, Austin, TX (US); Joseph B. Wieck, Austin, TX (US); Edward B. McCauley, Cedar Park, TX (US); Scott T. Quarmby, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 240 days.

(21) Appl. No.: 12/060,509

(22) Filed: Apr. 1, 2008

(65) Prior Publication Data

US 2009/0242747 A1 Oct. 1, 2009

(51) Int. Cl.
*H01J 49/40* (2006.01)
*H01J 49/02* (2006.01)

(52) U.S. Cl. ..... 250/288; 250/281; 250/282; 250/424; 313/231.31; 313/231.01

(58) Field of Classification Search ..... 250/281, 250/282, 288, 423 R, 424; 313/230.01, 231.31, 313/231.41, 362.1
See application file for complete search history.

(56) References Cited

U.S. PATENT DOCUMENTS 3,723,729 A 3/1973 Kruger et al.
4,388,531 A * 6/1983 Stafford et al. ..... 250/427
4,686,365 A * 8/1987 Meek et al. ..... 250/281
4,816,685 A * 3/1989 Lange ..... 250/427
5,504,327 A * 4/1996 Sproch et al. ..... 250/288
6,797,948 B1 9/2004 Wang
7,034,292 B1 4/2006 Whitehouse et al.
7,041,984 B2 * 5/2006 Ellefson et al. ..... 250/427
7,047,171 B1 * 5/2006 Sproch ..... 703/12
7,323,682 B2 * 1/2008 McCauley et al. ..... 250/287
7,507,954 B2 * 3/2009 McCauley et al. ..... 250/288
7,622,713 B2 * 11/2009 Quarmby et al. ..... 250/288
2009/0032702 A1 * 2/2009 Quarmby et al. ..... 250/288
2009/0242747 A1 * 10/2009 Guckenberger et al. ..... 250/281

FOREIGN PATENT DOCUMENTS

GB 2 355 108 A 4/2001

* cited by examiner

*Primary Examiner*—Bernard E Souw
(74) *Attorney, Agent, or Firm*—Michael C. Staggs

(57) ABSTRACT

A method and apparatus of combining an ion volume, a lens stack, and an ion optic that similarly cooperates with a detached multipole ion guide is herein incorporated into a single sub-assembly that can be removed from a mass spectrometer instrument without venting. Such an arrangement allows an operator to clean all parts of the ion path that get contaminated in normal operation, reassemble and reinsert in a timely manner and then pump down to an acceptable vacuum without having to vent the system.

20 Claims, 5 Drawing Sheets

REMOVABLE ION SOURCE THAT DOES NOT REQUIRE VENTING OF THE VACUUM CHAMBER

BACKGROUND OF THE INVENTION

1. Field of the Invention

The present invention relates to the field of mass spectrometry, and more particularly to the field of removable ionization chambers and removable components in associated ion guides that are often configured for mass spectrometers.

2. Discussion of the Related Art

The ion source utilized in conventional mass spectrometers can include an ion volume, a lens stack, and a radio frequency (RF) multipole ion guide. Currently, the ion volume can be removed without venting the instrument. Such an arrangement enables a user to remove the contaminated parts associated with the ion volume, clean them, or replace them so as to continue operating the instrument without breaking the vacuum. However, such a solution only works when the cleanliness of parts configured within the ion volume is the limiting factor in restoring the ion source performance. When the lens stack or the ion guide becomes contaminated such that the instrument sensitivity is inadequate, the instrument must be vented and the entire source must be removed for cleaning.

Background information for an system having interchangeable ionization chambers, is described and claimed in U.S. Pat. No. 4,388,531, entitled "Ionizer Having Interchangeable Ionization Chamber," issued Jun. 14, 1983, to Stafford et al., including the following, "An ionizer adapted to be placed in a vacuum envelope for providing ions of a sample to be analyzed is disclosed herein and includes an electron source, ion accelerating and focusing electrodes and an interchangeable ionization chamber . . . . "

Additional background information for a mass spectrometer having a replaceable ionization chamber, is described and claimed in U.S. Pat. No. 3,723,729, entitled "Ionization Chamber For Use With A Mass Spectrometer," issued Mar. 27, 1973, to Kruger et al., including the following, "A replaceable ionization chamber for a mass spectrometer comprises an ionization region defined by two parallel perforated membranes attached to concentric tubular electrodes which are separated by the ionization region. Two filaments and two electron focusing electrodes are symmetrically disposed about the periphery of the ionization region, and sample input ports are similarly disposed about the periphery."

Background information for a mass spectrometer having segmented RF ion guides, is described and claimed in U.S. Pat. No. 7,034,292 B1, entitled "Mass Spectrometry With Segmented RF Multiple Ion Guides In Various Pressure Regions," issued Apr. 25, 2006, to Whitehouse et al., including the following, "A mass spectrometer is configured with individual multipole ion guides, configured in an assembly in alignment along a common centerline wherein at least a portion of at least one multipole ion guide mounted in the assembly resides in a vacuum region with higher background pressure, and the other portion resides in a vacuum region with lower background pressure. Said multipole ion guides are operated in mass to charge selection and ion fragmentation modes, in either a high or low pressure region, said region being selected according to the optimum pressure or pressure gradient for the function performed. The diameter, lengths and applied frequencies and phases on these contiguous ion guides may be the same or may differ. A variety of MS and $MS/MS^n$ analysis functions can be achieved using a series of contiguous multipole ion guides operating in either higher background vacuum pressures, or along pressure gradients in the region where the pressure drops from high to low pressure, or in low pressure regions. Individual sets of RF, +/−DC and resonant frequency waveform voltage supplies provide potentials to the rods of each multipole ion guide allowing the operation of ion transmission, ion trapping, mass to charge selection and ion fragmentation functions independently in each ion guide."

Accordingly, a large customer need exists for a single mass spectrometer ion source sub-assembly (i.e., an ion source, lens stack, and a pre-filter configured as part of the ion guide), which collectively can be removed from the instrument without venting the system. Such an arrangement allows a user to clean all parts of the ion path that get contaminated in normal operation in a time efficient manner. The present invention is directed to such a need.

SUMMARY OF THE INVENTION

Accordingly, the present invention provides a removable ion source sub-assembly that can be removed from a mass spectrometer instrument without venting. In particular, such an apparatus can include: an ion volume; one or more lenses; an ion optic adapted to be in cooperative relationship with a secured multipole configured with a mass spectrometer; and a means for removably securing the ion volume, the lenses, and the ion optic as a unit in said spectrometer so that when removed as a unit, the ion volume, the lenses, and/or the ion optic can be cleaned and/or replaced and returned to the mass spectrometer for operation as a unit without having to vent a common enclosing vacuum.

In another aspect, the present invention is directed to a segmented mass spectrometer multipole that includes: a secured multipole; a removable ion optic assembly configured with a plurality of electrodes having lengths of up to about 2 cm and a means for removably positioning the ion optic assembly so as to be in cooperative relationship with the secured multipole. Such an arrangement enables the front face of the multipole to be removed for disassembly so as to clean and/or replace individual parts for reinsertion back into an operating system without having to vent a common enclosing vacuum.

Accordingly, the present invention is directed to a novel method and single sub-assembly compact unit that includes an ion volume, lens stack, and an ion optic section that along with other benefits, enables efficient heating and cooling as well as smaller vacuum interlocks and removal tools to enable a user to clean all parts of an ion path that gets contaminated in normal operations without spending the time to vent the instrument and then pump such a system down to an acceptable vacuum. Other benefits include, but are not limited to, reducing the potential of breaking something, such as, but not limited to, heater cartridges, elements on a resistance temperature detector (RTD), etc. during the cleaning/replacement operation and that there are also no wires to mix up, a benefit even if there is no vacuum interlock.

DETAILED DESCRIPTION

Figure 1A:
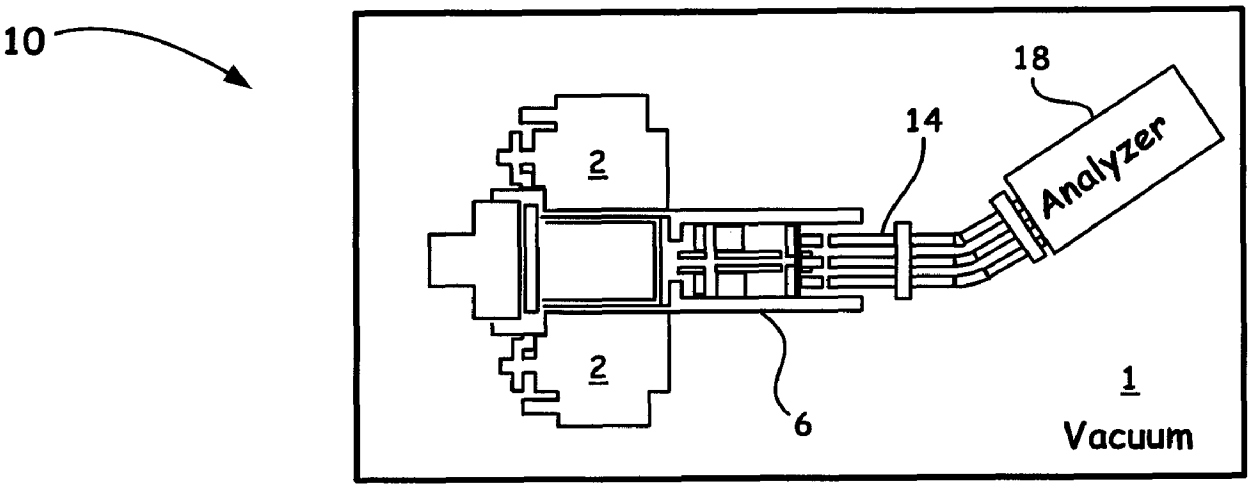
FIG. 1A shows a general assembled spectrometer system that includes the removable ion source sub-assembly of the present invention.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise.

Moreover, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

Certain markets that use mass spectrometers are focused on running as many samples through the instrument as possible. The time required to vent, disassemble, clean, reassemble, and then pump down the system back to operating pressures is costly and time inefficient. However, a significant amount of time/cost savings can be obtained in the operation if the venting and pump down aspects of maintenance can be removed from the equation. The present invention addresses such a market need by combining parts of the ion source, such as, for example, the ion volume, the lens stack, and an RF ion optic segment into a compact removable unit. Such a unit, which operationally cooperates with the bulk ion guide of the system, is designed with an overall length of up to about 70 mm with all integral parts being mechanically coupled and secured in precise alignment so as to be easily removed for cleaning and/or replacement in a single operation without having to vent the instrument.

The general component breakdown of the removable ion source sub-assembly of the present invention includes an ion volume section capable of operating in a mode, such as, but not limited to, an electron ionization (EI) mode, a chemical ionization (CI) mode, or an EI/CI combo mode. Such a chosen mode is beneficially designed to utilize generated electrons from an electron source by providing a site for such electrons for interaction with a sample or reagent gas molecules to enable the formation of ions. The formed ions can be extracted via a predetermined electrical potential between the wall of the ion volume and of an integrated element(s) within such an ion volume, such as, for example, a repeller electrode having the same polarity of the generated ions, which is often housed within the ion volume and thus removable with the rest of the sub-assembly.

As part of the example arrangements disclosed herein, the ion source sub-assembly also often includes an ion lens having a predetermined polarity (e.g., for a positive ion, the potential with respect ground for the lens should be below the potential with respect to ground of the ion volume) in sign with respect to the ions formed within the ion volume to extract such ions to enable subsequent focusing by configured additional one or more ion lenses that comprise an overall lens stack. Thereafter, the generated ions are capable of being directed via a novel ion optic of the present invention, which is also constructed to be removable with the rest of the novel sub-assembly of the present invention. As example arrangements, the ion optic, as disclosed herein, generally comprises a plurality of electrodes (rods, often flat electrodes) configured as a multipole structure (e.g., octapoles, hexapoles, more often quadrupoles) designed to have a length from about 2 mm up to about 2 cm, more often having a length of up to about 1 cm, which are operationally coupled to the ion guide that resides in the instrument, such as, a straight multipole ion guide but more often, a curved multipole ion guide.

To appreciate the beneficial aspects of such an arrangement, it is to be noted and it is understood by those of ordinary skill in the art that such multipole ion guiding structures in general, often get contaminated (e.g., up to about the first 2 cm of multipole ion guides, more often up to about the first cm of multipole ion guides) during normal operation as a result of low-mass cut-off and because of impinging neutrals to necessitate extraction for cleaning. However, the bulk of the ion guide after the contaminated region does not get appreciably dirty during operation. Therefore, the configurations of the present invention addresses such a deleterious contamination effect by enabling the removal of the ion optic (via coupling with the removable sub-assembly) which often similarly operates (e.g., in cooperative relationship) as part of the front section of the ion guide. Thus, because the ion optic of the present invention cooperates similarly with the fixed ion guide that resides in the instrument, such a component can be easily removed with the rest of the novel ion source sub-assembly, e.g., the ion volume and the lens stack, for cleaning and/or replacement if such a procedure is required.

It is to be appreciated and noted however, that cooperative relationship of the ion optic, as disclosed herein, often comprises the ion optic to be configured with the same electrode number, shape (e.g., hyperbolic, flat, etc.), potential, wiring, and electrode separation ($r_0$) as the coupled multipoles of the present invention. However, while such cooperative relationship arrangements are desirable, it is also to be appreciated that cooperative relationship also comprises configurations having dissimilar electrode numbers, dissimilar potentials and wiring (e.g., the ion optic can be operated with an RF potential while the coupled multipole is configured with an RF/DC or vice versa), dissimilar electrode separation ($r_0$), as well as different shapes from such coupled multipoles so as to operate within the spirit and scope of the present invention. Moreover, cooperative relationship can also entail the electrodes of the ion optic to be in physical contact with the electrodes or adjacently coupled.

Accordingly, the ion optic, as disclosed and as claimed in the present application, is configured to be removed with the rest of the sub-assembly (e.g., the ion volume and lens stack) so as individually or in total be cleaned and/or replaced in a time efficient manner to maintain system performance while the substantial remainder of the ion guide remains in place, all without venting and beneficially, without disrupting the analyzer portion of the instrument.

Specific Description

Figure 1B:
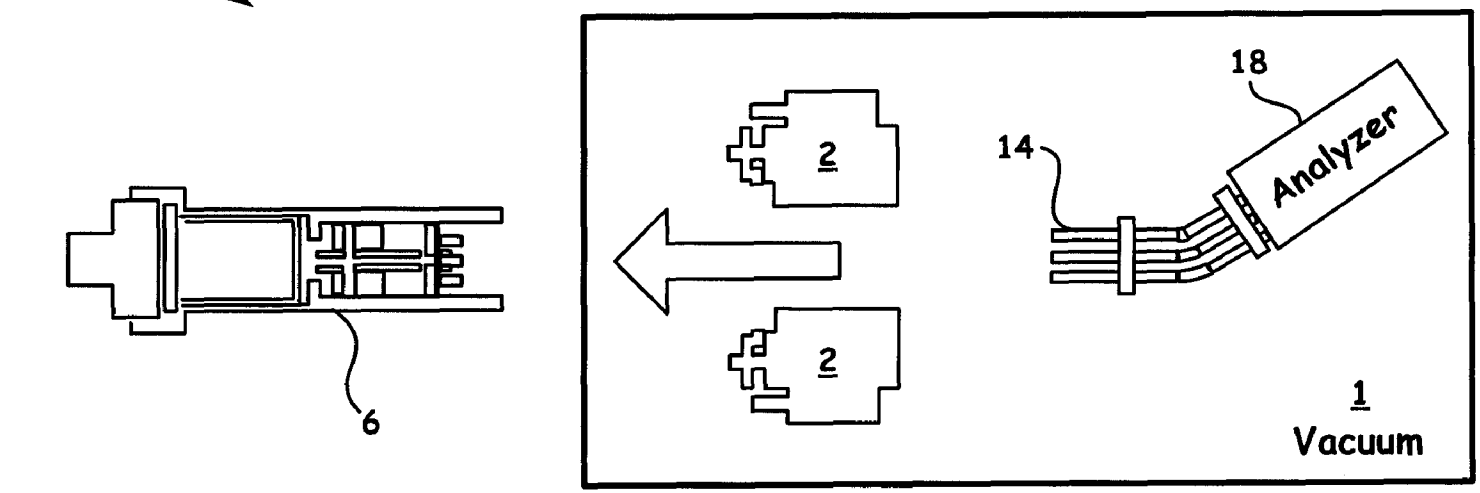
FIG. 1B generally illustrates the novel removable capability of the ion source sub-assembly.

Turning now to the drawings, FIG. 1*a* and FIG. 1*b* FIG. 1A and FIG. 1B generally designated by the reference numerals 10 and 10' respectively, illustrate the novel beneficial sub-assembly principles for a spectrometer system, often a mass spectrometer, and more often, a Gas Chromatography (GC) mass spectrometer, of the present invention. In particular, FIG. 1A shows an assembled spectrometer system 10, which generally includes, but is not limited to, a heater block 2, a novel removable ion source sub-assembly 6, an ion guide 14, and a single analyzer 18, which accepts ions from the ion guide 14.

It is to be appreciated that the single analyzer 18, as shown in FIG. 1A, can include a variety of single stage analyzer systems capable of mass spectrometry, such as, for example, a time-of-flight (TOF) device, a linear ion trap (LIT), magnetic and electrostatic analyzers, a quadrupole, an ion cyclotron resonance (ICR) instrument, an orbitrap, or a Fourier Transform Mass Spectrometer (FTMS). Moreover, the embodiments of the present invention can also be utilized in a tandem mass spectrometer with more than one analyzer (known as tandem in space), as known to those of ordinary skill in the art. For example, one mass analyzer can isolate one precursor from many precursors entering a mass analyzer, after which the isolated precursor is collided with a gas within a collision cell causing fragmentation of the isolated precursor. A second mass analyzer then can catalog the fragments produced from the fragmented isolated precursor.

It is also to be appreciated that while a straight ion guide can be adapted with the present invention, more often the present invention utilizes a curved multipole pre-filter ion guide 14 (e.g., a hexapole, an octapole, more often a quadrupole) to provide a path that predetermined ions and excited neutrals cannot navigate. It is to be noted that such pole structures of the present invention can be operated either in the radio frequency (RF) mode only or the RF/DC mode. When only an RF voltage is applied between predetermined electrodes (e.g., rod pairs, flat electrode pairs) the apparatus is operated to transmit ions above some threshold mass. When a combination of RF and DC voltages is applied between rod pairs there is both an upper cutoff mass as well as a lower cutoff mass. As the ratio of DC to RF voltage increases, the transmission band of ion masses narrows. Thus, as known to those skilled in the art, a mass filter operation can be arranged when the applied ratio of DC to RF is designed so that the pass band of the instrument allows only a single ion mass to transmit.

For a curved pole structure operating as an ion guide 14, as in FIG. 1A and FIG. 1B, the focusing nature of the mulitpole field (often a quadrupole field) can be configured to operate as a neutral noise and ion prefilter while guiding desired ions within the pass band along the curved axis of the device in order to be interrogated by the analyzer 18. Based on such an arrangement, neutrals and ions with masses near the limits of the pass band do not experience the effects of the ion guide to follow the curved ion path and are not transmitted. Such non-transmitted particles are often the source of contaminating up to about 2 cm of a conventional ion guide, more often up to about the first cm of such a device.

The disassembled system 10', as shown in FIG. 1B, further illustrates the novel capabilities of the present invention, wherein the ion source subassembly 6 is shown removably decoupled from the assembled mass spectrometry system 10 of FIG. 1A. In a method of operation, the subassembly 6, can be removed (as denoted with the directional arrow) if desired when, for example, system performance has declined, in anticipation of such an event, or for general tune-up procedures when utilizing such instruments.

Accordingly, the subassembly 6, as shown in FIG. 1B, is beneficially designed to be decoupled from the heater block 2/ion guide 14/analyzer 18 spectrometer system 10' from, as one example arrangement, a common or segmented vacuum enclosure 1 via an insertion/removal (I/R) tool (not shown). The I/R tool is thus generally maneuvered through an entry valve (not shown) that provides a vacuum-tight seal around the I/R tool and is mechanically affixed to the subassembly via, for example, pins (not shown) that are designed to couple to designed structures (e.g. guides) configured on a sleeve-like housing of the subassembly 6. The sub-assembly 6 is then removed and often fully disassembled for cleaning or replacement of individually mechanically coupled parts and then reassembled for insertion back into the system 10, as shown in FIG. 1A, so to enable normal operation.

Figure 2A:
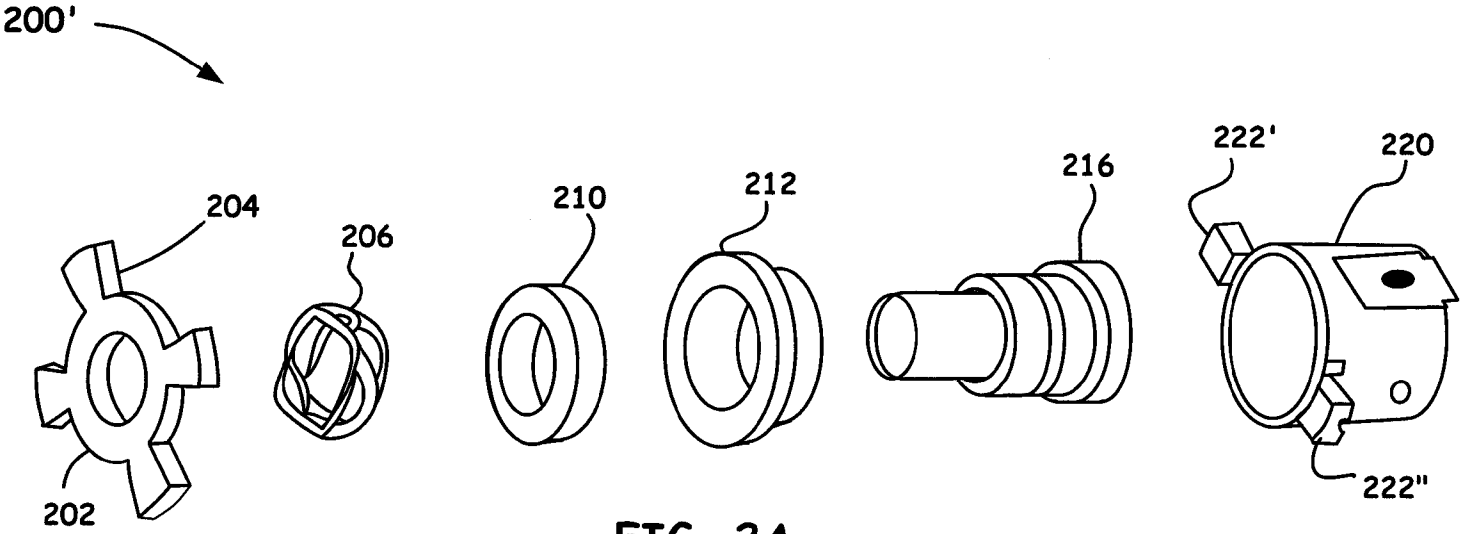
FIG. 2A shows a beneficial arrangement of parts for the ion-source first sub-assembly of the present invention.
Figure 2B:
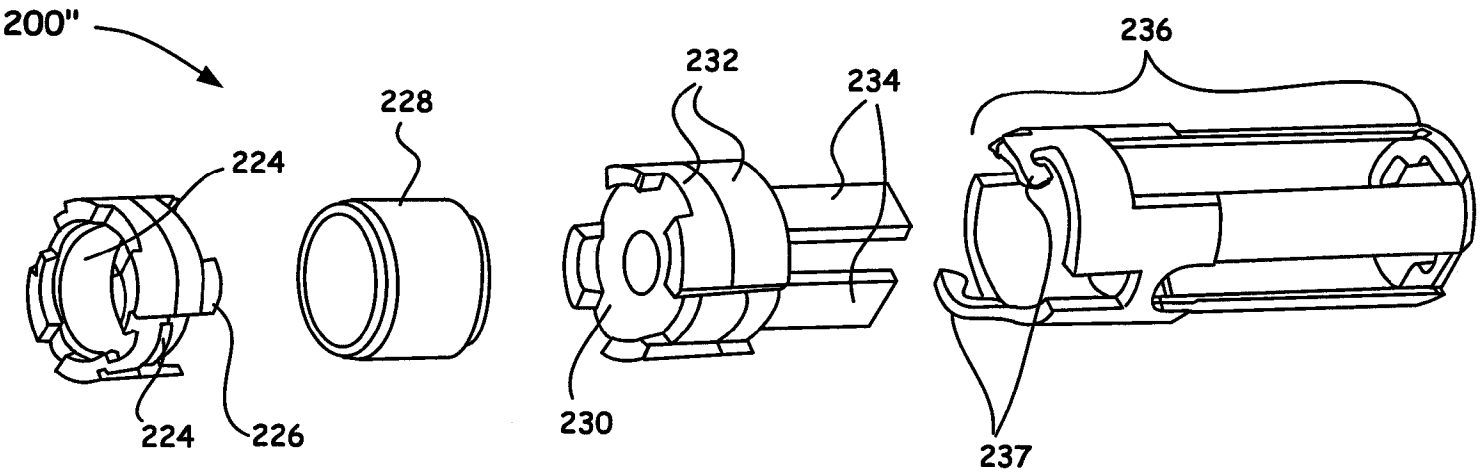
FIG. 2B shows a beneficial arrangement of parts for the ion-source second sub-assembly of the present invention.
Figure 3:
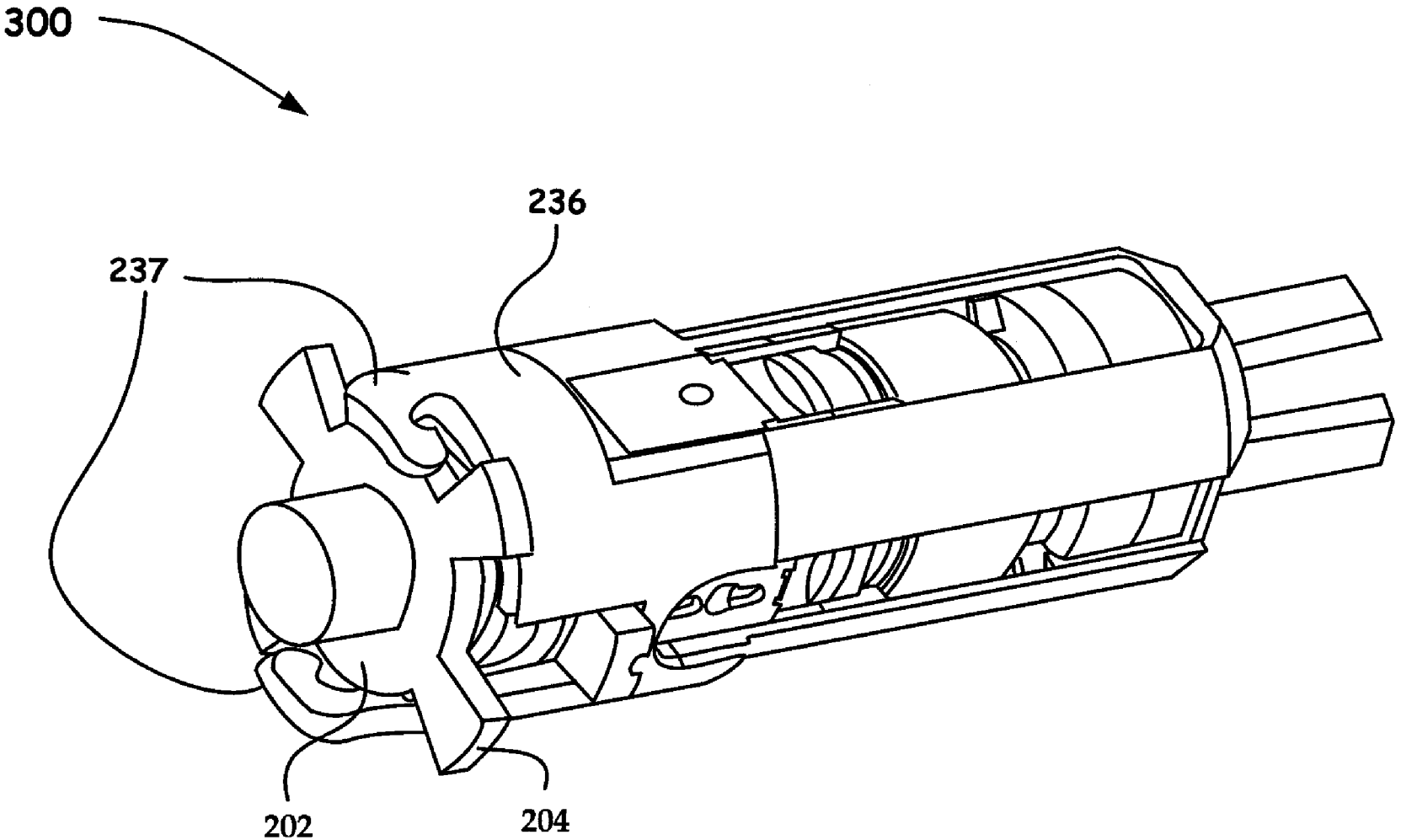
FIG. 3 shows a beneficial ion source sub-assembly configured in its integral arrangement.

FIG. 2A and FIG. 2B show an example beneficial first and second sub-assembly of parts that can, as a complete assembly, be mechanically coupled and electrically operated to provide an ion source, such as, for example, an ion source sub-assembly of the present invention, as shown in FIG. 3 (generally designated by the reference numeral 300). In particular and in order to illustrate an example novel arrangement(s) of the present invention, FIG. 2A shows a group of first parts that are arranged as a first sub-assembly associated with an ion volume, generally designated by the reference numeral 200' that can be decoupled from an integral removable securing means 236, which is generally illustrated in FIG. 2B.

Before discussing the ion volume sub-assembly illustrated in FIG. 2B, it is to be appreciated that the removable securing means 236 that houses the entire example arrangement of parts, as shown referenced in FIG. 2A and FIG. 2B, is capable of being sized, shaped, and oriented to provide a molded and/or a sheet metal and/or a ceramic and/or a machined sleeve, often a metal sleeve, more often a stainless steel sleeve, so as to enable thermal and mechanical stability while coupling in alignment, each of the example parts shown in FIG. 2A and FIG. 2B. Moreover, it is also to be appreciated that the removable securing means 236, as shown in FIG. 2B as well as in FIG. 3, can also take other shapes or designs not shown in the figures without departing from the scope and spirit of the present invention in order to mechanically communicate with an insertion/removal tool for integration into a mass spectrometer, e.g., a GC mass spectrometer, as known and understood by those skilled in the art.

Turning back to FIG. 2A such example parts of the ion volume sub-assembly 200', shown in a disassembled state for clarity of the present invention, are capable of being extracted from the removable securing means 236 and can include, but are not limited to, an ion volume 220, a repeller electrode 216, an insulator 212, a retaining means 210, a resilient member 206, and a locking means 202. The ion volume 220 of the present invention is often, but not necessarily configured with locating lugs 222' and 222", which are often arranged with different widths to prevent improper insertion (e.g., installing upside down). In addition, the ion volume 220 itself is often designed to have an inside diameter of between about 9.5 mm up to about 13 mm and can be configured with a predetermined snout (not shown) that helps align the ion volume 220 with installed insulators (e.g., insulator 212) and configured lenses.

As discussed above, such an ion volume 220, as utilized herein, provides a site for generated electrons to interact with a sample or reagent gas molecules to form ions, wherein the formed ions are then extracted via a predetermined electrical potential between the wall of the ion volume 220 and of an integrated element, such as, for example, the repeller electrode 216 configured to have the same polarity of the generated ions with respect to the ion volume. To situate and insulate the repeller electrode 216, the insulator 212, often a ceramic insulator, such as, but not limited to, an alumina insulator from about 85% up to about 99.8% pure alumina (e.g., 96%), is arranged with a minimum thickness of about 1 mm, an inside diameter of about 10 mm and an outside diameter of up to about 13 mm is removably secured to the repeller electrode 216 via the retaining means 210 (e.g., a bushing). Thereafter a resilient member 206 (e.g., a spring) is often configured to compress all of the components in FIG. 2A as well as in FIG. 2B within removable securing means 236 and is held in such a compressive state along with all of the other components generally shown in FIG. 2B, via a locking means 202 configured with one or more tabs 204.

The tab design on locking means 202 enables ion source sub-assembly 300 as shown in FIG. 3, to be secured into a plate (not shown) configured with the heater block 2, as shown in FIG. 1A and FIG. 1B, and such a tab design enables the entire ion source sub-assembly 300, as shown in FIG. 3, to be easily and quickly decoupled from the heater block assembly 2 via a specially designed insertion/removal tool (not shown) that maneuvers in between such tabs so as to couple with the guides 237 that are configured on the removable means 236, as shown in FIG. 2B as well as in FIG. 3.

Continuing on in the description of the entire ion source sub-assembly 300, as shown in FIG. 3, FIG. 2B shows a second sub-assembly designated by the reference numeral 200", which comprises: a first lens 224 (e.g., a stainless steel lens insert molded into glass bonded mica, e.g., a ceramoplastic such as, Mycalex) coupled with an insulator 226, a second lens 228 (e.g. a stainless steel precision machined lens), a third lens 230 (e.g., a stainless steel insert molded lens) coupled with a second insulator 232, a plurality of electrodes 234 configured to similarly operate in conjunction with an ion guide attached to an analyzer (e.g., guide 14, as shown in FIG. 1A and FIG. 1B), and a removable securing means 236 designed to mechanically couple the example components illustrated in FIG. 2A and FIG. 2B.

It is to be appreciated that the first lens 224, the second lens 228, and the third lens 230, comprise as a group, a lens stack with each lens within the stack being configured with a predetermined potential with respect to ground to enable the generated ions to be extracted and focused and thus directed to an ion guide, such as, a straight but more often a curved ion guide, as disclosed herein. It is also to be appreciated that insulators 226 and 232 configured with such lenses are often configured with widths of up to about 1 mm, an inside diameter of up to about 10 mm, and an outside diameter of up to about 13 mm, and are often molded materials, more often molded from ceramic, ceramoplastic, or polyimide engineering plastic materials, such as, but not limited to Mycalex or Vespel, which can be machined to precise tolerances and into complicated shapes with conventional tooling. Moreover, such ceramic, ceramoplastic, or polyimide engineering materials are desired in the present invention because they can be used in high temperature applications of up to about 1300 degrees F., (e.g., from about 550 degrees F. up to about 900 degrees F. for Vespel) have excellent electrical and thermal insulating properties, low moisture absorption of less than about 0.5% at room temperature (zero porosity), good physical strength, and are impact resistant with the beneficial ability to withstand thermal cycling.

Such insulating properties enable thermal stability of the entire ion source sub-assembly 300, as shown in FIG. 3, while being heated either in parallel (e.g., the heat is directed from above the ion source sub-assembly 300 and into all parts at the same time) or serially (e.g., the heat is directed from a predetermined end of the ion source sub-assembly 300). Moreover, the arrangement of the insulators, as disclosed herein, enable heating of the plurality of electrodes 234 along with each of the lenses, i.e., a lens stack that can comprise first lens 226, second lens 228, with temperatures of up to about 1300 degrees F., often from about 392 degrees F. up to about 662 degrees F., while also providing thermal isolation of the lenses, as is often desired, from the ion volume 220 but also beneficially, the multipole guide 14, so that undesirable heat does not reach the mass analyzer 18, as shown in FIGS. 1A and 1B.

Figure 4A:
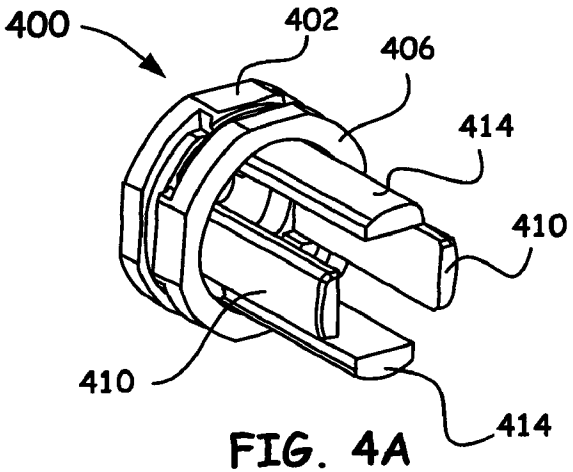
FIG. 4A illustrates an example ion optic of the present invention.
Figure 4B:
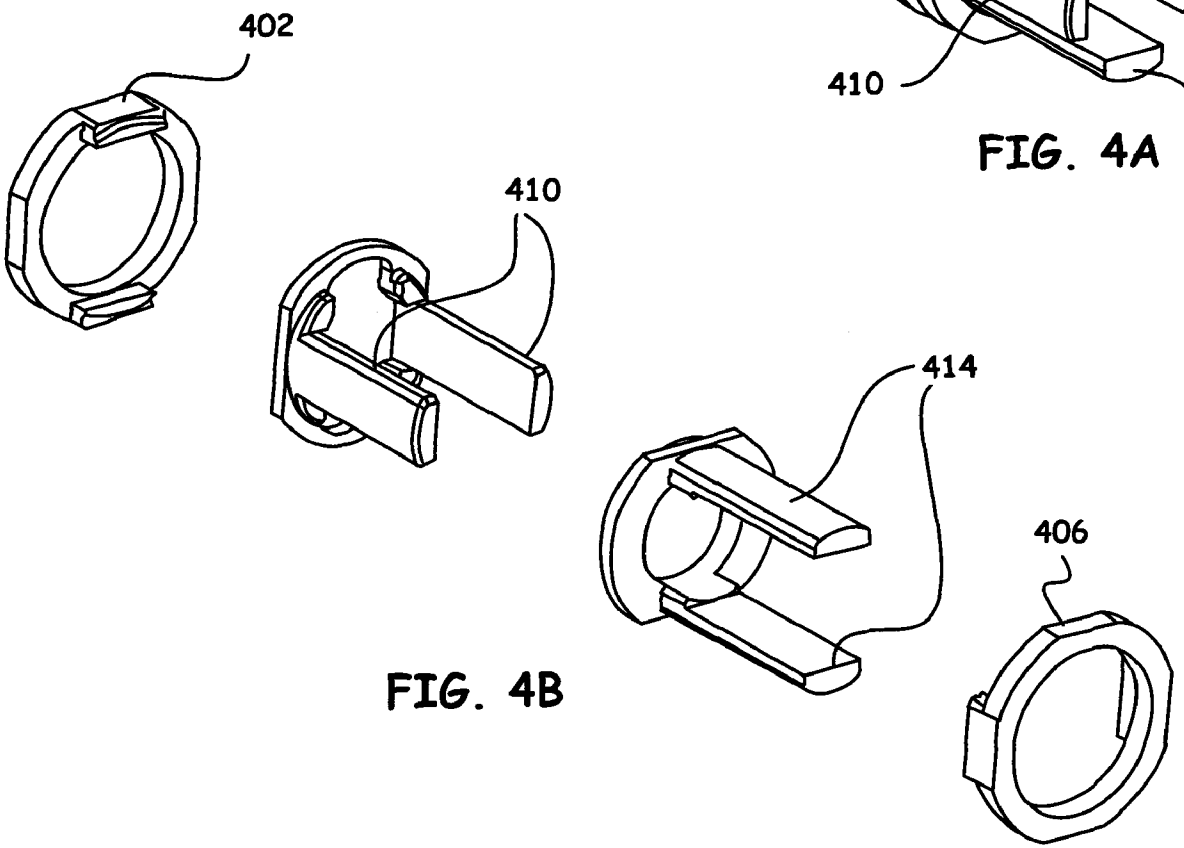
FIG. 4B shows a break down of the example ion optic illustrated in FIG. 4A.

FIG. 4A (as shown in an enclosed box) illustrates a beneficial example configuration for an ion optic, as designated by the reference numeral 400. FIG. 4B specifically shows a break down of such an example ion optic 400, having a first 402 and a second 406 insulator (e.g., ceramic molded insulators), and a first 410 and a second pair of electrodes 414. Thus, the example configuration of FIG. 4B results in a quadrupole structure that when coupled with the guide 14, as shown in FIG. 1A and FIG. 1B, operates systematically in a similar ion guiding manner.

It is to be noted that while the beneficial example embodiments of FIG. 4A and FIG. 4B are shown with four electrodes so as to illustrate a quadrupole structure, the ion optic embodiments of the present invention can equally be arranged with other electrode structures so as to couple effectively to other multipole guide structures, such as, but not limited to, hexapoles and octapoles. Therefore, as briefly discussed above, the ion optic 400 of the present invention can comprise a plurality of electrodes (often flat electrodes) configured as a multipole structure (e.g., an octapole, a hexapole, more often a quadrupole) that is designed to have a length of up to about 2 cm, often having a length from about 2 mm up to about 2 cm, more often having a length from about 2 mm up to about 1 cm, which are electrically coupled and matched to the multipole structures configured in the bulk remainder of the ion guide but is mechanically coupled with the rest of the novel removable sub-assembly of the present invention. Such a configuration enables the ion optic to cooperate similarly with the bulk fixed ion guide but the ion optic 400 itself is beneficially removable with the rest of the novel sub-assembly, as shown and as discussed herein, for cleaning or replacement when any or all of the parts of the ion source sub-assembly, such as, the ion volume, the lens stack or in this particular instance, the ion optic becomes contaminated.

Figure 5A:
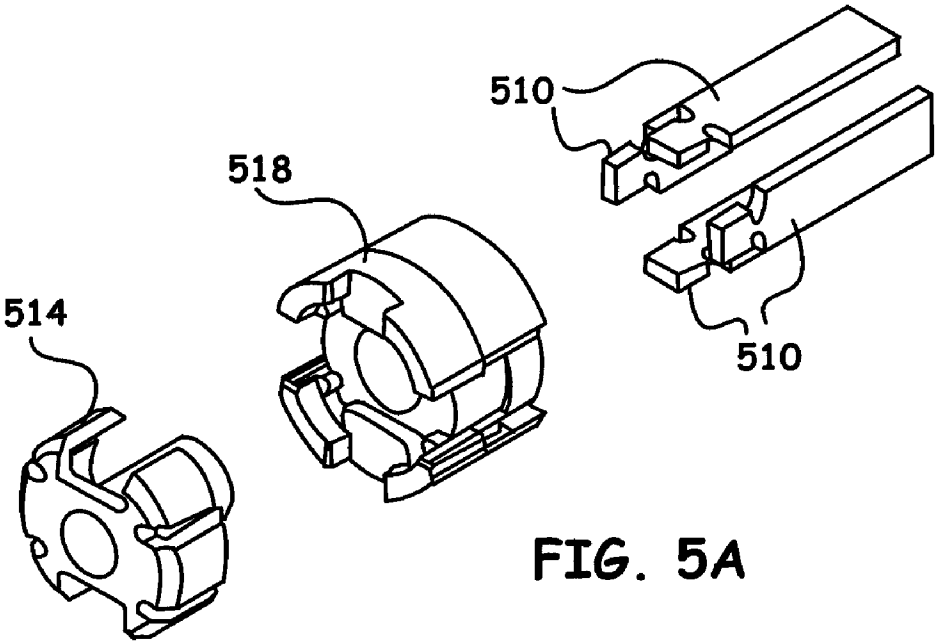
FIG. 5A illustrates another beneficial ion optic assembly of the present invention.
Figure 5B:
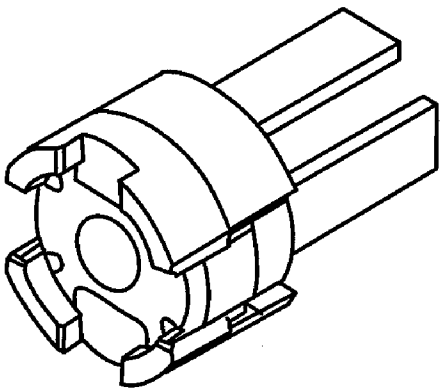
FIG. 5B illustrates the integral arrangement of the ion optic example resulting from the assembly shown in FIG. 5A.

FIG. 5A and FIG. 5B illustrates another beneficial example arrangement in producing an ion optic of the present invention. The electrodes pairs, 414 and 410 as shown in FIG. 4A and FIG. 4B above, can also be configured as split discrete electrodes 510, as shown detailed in FIG. 5A, e.g., electrode rods that are not connected. These rods (i.e., electrodes 510)

are then placed into an injection molded tool (not shown) along with lens 3 514 to provide a moldable ceramic insulator 518 (e.g., mycalex) shown decoupled for clarity, which is shot around them so as to create a single part with the electrodes 510, the lens 3 514, and insulator 518, bonded together to form the integral assembly shown in FIG. 5B. Such a beneficial arrangement reduces the part count for the user to clean and ensures that the electrodes 510 do not touch themselves or lens 3 514.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention, as defined by the following claims.

The invention claimed is:

1. A removable ion source sub-assembly, comprising:

an ion volume;

one or more lenses;

an ion optic adapted to be in cooperative relationship with a secured multipole configured with a mass spectrometer; and means for removably securing said ion volume, said one or more lenses, and said ion optic as a unit in said spectrometer so that when removed as said unit, at least one of said ion volume, said one or more lenses, and said ion optic can be cleaned and/or replaced and returned to said mass spectrometer for operation as said unit without having to vent a common enclosing vacuum.

2. The removable ion source sub-assembly of claim 1, wherein said ion optic comprises a multipole.

3. The removable ion source sub-assembly of claim 2, wherein said multipole and said fixidly secured multipole comprise at least one multipole selected from: an octopole, a hexapole, and a quadrupole.

4. The removable ion source sub-assembly of claim 2, wherein said ion optic comprises a multipole configured with a plurality of flat electrodes.

5. The removable ion source sub-assembly of claim 4, wherein each of said plurality of flat electrodes comprises a length of up to about 2 cm.

6. The removable ion source sub-assembly of claim 4, wherein each of said plurality of flat electrodes comprises a length of between about 2 mm up to about 1 cm.

7. The removable ion source sub-assembly of claim 1, wherein said unit comprises a length of up to about 70 mm.

8. The removable ion source sub-assembly of claim 1, wherein said ion optic and said fixidly secured multipole are configured to cooperatively operate as an RF multipole.

9. The removable ion source sub-assembly of claim 1, wherein said ion optic and said fixidly secured multipole are configured to cooperatively operate as an RF and DC multipole.

10. The removable ion source sub-assembly of claim 1, wherein said ion optic performs a low-mass cut-off function.

11. The removable ion source sub-assembly of claim 1, wherein said sub-assembly further comprises at least one of: a repeller, one or more locking members, and one or more insulators.

12. The removable ion source sub-assembly of claim 1, wherein said means for removably securing is configured to enable removal and/or insertion by way of a tool.

13. The removable ion source sub-assembly of claim 1, wherein one or more electrical contacts adapted with said ion optic and said fixidly secured multipole are from the same source.

14. A segmented mass spectrometer multipole, comprising:

a secured multipole;

a removable ion optic assembly, said ion optic further comprising:

a) a first plurality of electrodes configured with lengths of up to about 2 cm;

b) a second plurality of electrodes mechanically coupled with said first plurality of electrodes and also configured with lengths of up to about 2 cm; and means for removably positioning said ion optic assembly so as to be in cooperative relationship with said secured multipole, said means being configured so that said ion optic can be disassembled from cooperative relationship with said secured multipole and removed without having to vent a common enclosing vacuum so that at least one of said first plurality of electrodes and said second plurality of electrodes can be cleaned and/or replaced and returned as said ion optic assembly in said cooperative relationship with said secured multipole.

15. The segmented mass spectrometer multipole of claim 14, wherein said ion optic comprises a multipole.

16. The segmented mass spectrometer multipole of claim 15, wherein said multipole and said fixidly secured ion guide comprise at least one multipole selected from: an octopole, a hexapole, and a quadrupole.

17. The segmented mass spectrometer multipole of claim 15, wherein said multipole comprises a plurality of flat electrodes.

18. The segmented mass spectrometer multipole of claim 14, wherein said electrodes comprises a length of between about 2 mm up to about 1 cm.

19. The segmented mass spectrometer multipole of claim 14, wherein said ion optic and said fixidly secured multipole are configured to cooperatively operate as an RF multipole.

20. The segmented mass spectrometer multipole of claim 14, wherein said ion optic and said fixidly secured ion guide are configured to cooperatively operate as an RF and DC multipole.

* * * * *